US005551749A

United States Patent [19]

Reher et al.

[11] Patent Number: 5,551,749

[45] Date of Patent: Sep. 3, 1996

[54] CHILD SUPPORT CUSHION

[76] Inventors: Judy M. Reher, Richfield; Cindy Hanson, Buffalo, both of Minn.

[21] Appl. No.: 584,783

[22] Filed: Jan. 11, 1996

[51] Int. Cl.[6] ..... A47D 1/00

[52] U.S. Cl. ..... 297/219.12; 297/181; 297/228.13; 297/452.14; 297/467

[58] Field of Search ..... 297/130, 181, 297/219.1, 219.12, 228.1, 229, 256.16, 452.14, 452.15, 452.17, 467, 228.13

[56] References Cited

U.S. PATENT DOCUMENTS

| | | | |
|---|---|---|---|
| D. 294,099 | 2/1988 | Bromberg et al. | 297/229 X |
| 1,769,722 | 7/1930 | Sutton . | |
| 2,237,057 | 4/1941 | Meyer . | |
| 2,652,183 | 9/1953 | Hlivka . | |
| 2,736,364 | 2/1956 | Janus . | |
| 3,140,897 | 7/1964 | Dougherly | 297/228.1 |
| 3,841,704 | 10/1974 | Platner | 297/452.14 X |
| 3,934,934 | 1/1976 | Farrell, Jr. et al. . | |
| 4,383,713 | 5/1983 | Roston . | |
| 4,695,092 | 9/1987 | Hittie . | |
| 4,775,183 | 10/1988 | Tsuge et al. . | |
| 4,792,189 | 12/1988 | Shovar | 297/452.17 |
| 4,976,494 | 12/1990 | Polley . | |
| 5,071,192 | 12/1991 | Adler . | |
| 5,354,121 | 10/1994 | Allum . | |
| 5,372,405 | 12/1994 | Cash et al. . | |
| 5,385,385 | 1/1995 | Silverman . | |
| 5,427,426 | 6/1995 | Grappo | 297/344.26 X |

*Primary Examiner*—Peter R. Brown

*Attorney, Agent, or Firm*—Palmatier, Sjoquist & Helget, P.A.

[57] ABSTRACT

An infant support seat and cushion having an inner support structure including a backrest and seat and base support member and having a removable cushion assembly. The cushion assembly has a back cushion section, a seat cushion section and a pair of side support sections. An outer cover is attached to the cushion assembly and has a release mechanism to permit the insertion and removal of the inner support structure relative to the cushion assembly. A crotch support strap and detachable belt sections hold the infant in the cushion assembly in use.

6 Claims, 4 Drawing Sheets

CHILD SUPPORT CUSHION

BACKGROUND OF THE INVENTION

The present invention relates to a child support seat and cushion; more particularly the invention relates to a support seat and cushion useful for supporting small infants in an upright, seated position. The invention itself is particularly adapted for placement on a floor or other relatively flat support surface.

An infant support seat should provide a relatively soft seat cushion and support along a backrest, as well as support on either side of the backrest, because very small infants are unable to remain seated in an upright position without such support. In addition, the support seat should have a restraining belt or similar attachment which is adjustable to prevent the infant from falling forward out of the seat. If the infant support seat is intended for a particular application, as for example a support seat for use in a vehicle, there must be a mechanical attachment for securing the support seat to the vehicle.

The present invention is not intended for use in a vehicle but is primarily intended for supporting an infant in a seated position on a floor or similar flat surface. In this application it is a principal object to provide a safe and secure infant seat which will permit the infant's custodian an opportunity to engage in other activities, i.e. household activities, while keeping the infant under observation but without the need to physically hold the infant at all times. An advantage of the present invention is that it accomplishes this object while providing pleasant diversions for the infant's attention and stimulating the infant to perform various tactile exercises.

another object and advantage of the present invention is to provide a stable seating arrangement which will not tip over on its side when the infant is confined therein.

SUMMARY OF THE INVENTION

In accordance with the present invention, there is provided a formed and molded seat and backrest affixed to an enlarged flat support base which extends outwardly beyond the seat and backrest. This is removably inserted into an assembly comprising a padded cushion seat, side support cushions, and backrest cushion which assembly has an openable pocket for receiving the molded seat and backrest. The side support cushions each have toy-like attachments affixed thereto, and the entire cushion assembly may be shaped and configured as an animal body or in some other cartoon image which is pleasing to infants. The backrest cushion has a rear pocket for holding articles which cannot be reached by the infant, and a padded restraining harness is provided for adjustably confining the infant in the support seat.

BRIEF DESCRIPTION OF THE DRAWINGS

A preferred embodiment of the invention is described in the specification and claims herein, and with reference to the drawings, in which:

DESCRIPTION OF THE PREFERRED EMBODIMENT

Figure 1:
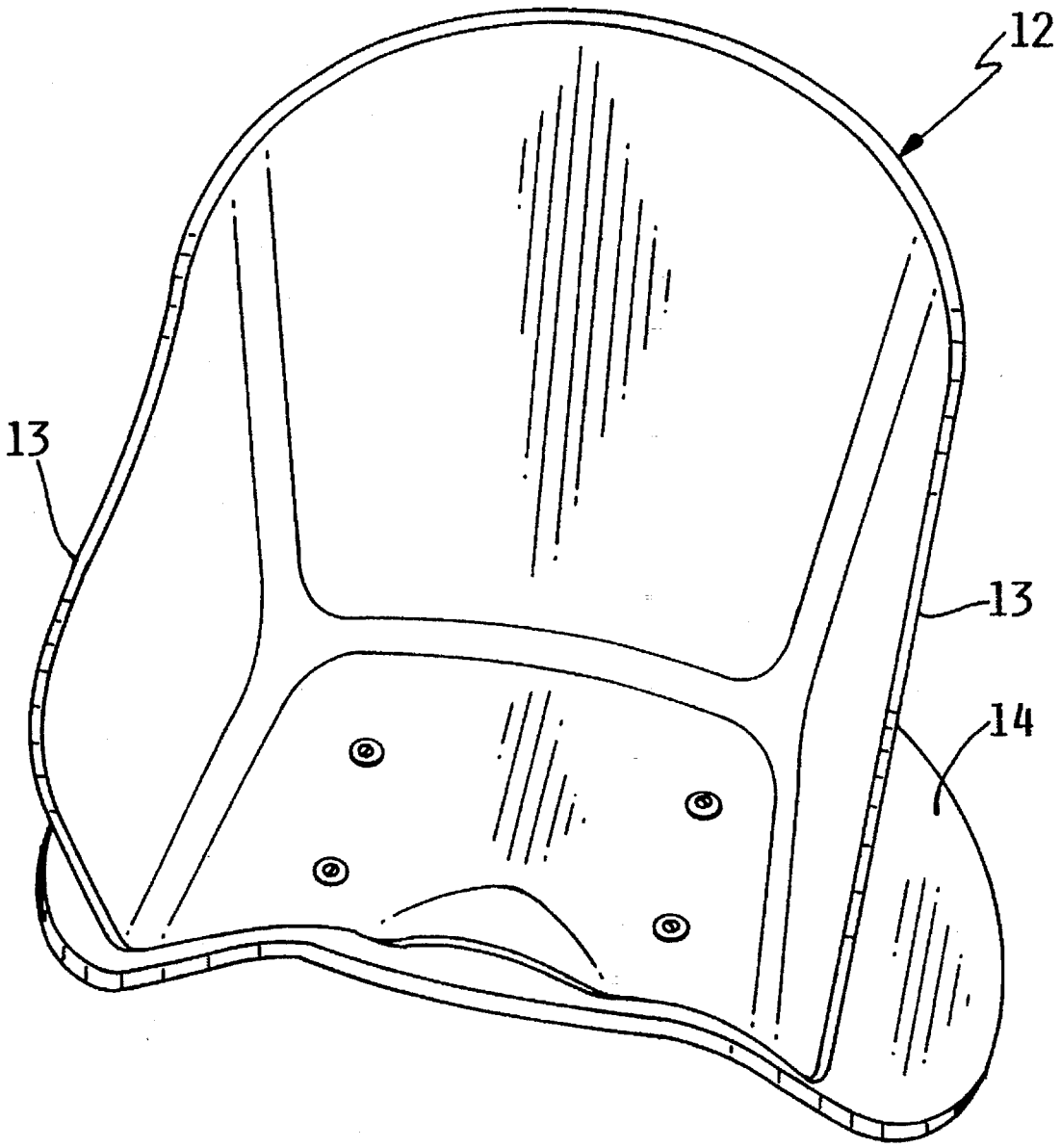
FIG. 1 shows an isometric view of the molded seat and support base of the invention.

Referring first to FIG. 1, the molded seat and support base of the invention is shown in isometric view. The molded seat and backrest 12 is preferably about 12–18 inches in height with side support walls 13 being curved to conform about the infant in a seated position. The side support walls 13 may be any desirable height and should be spaced apart a sufficient distance to allow for the cushion members and the infant's body. The molded seat and backrest 12 are affixed to a flat base support member 14 which extends outwardly beyond the seat and backrest on all sides. The base support member 14 and the seat and backrest may be formed from a single molded part or may be separately formed and later affixed together. These members may be made from plastic or fiberglass material or other similar material.

Figure 2:
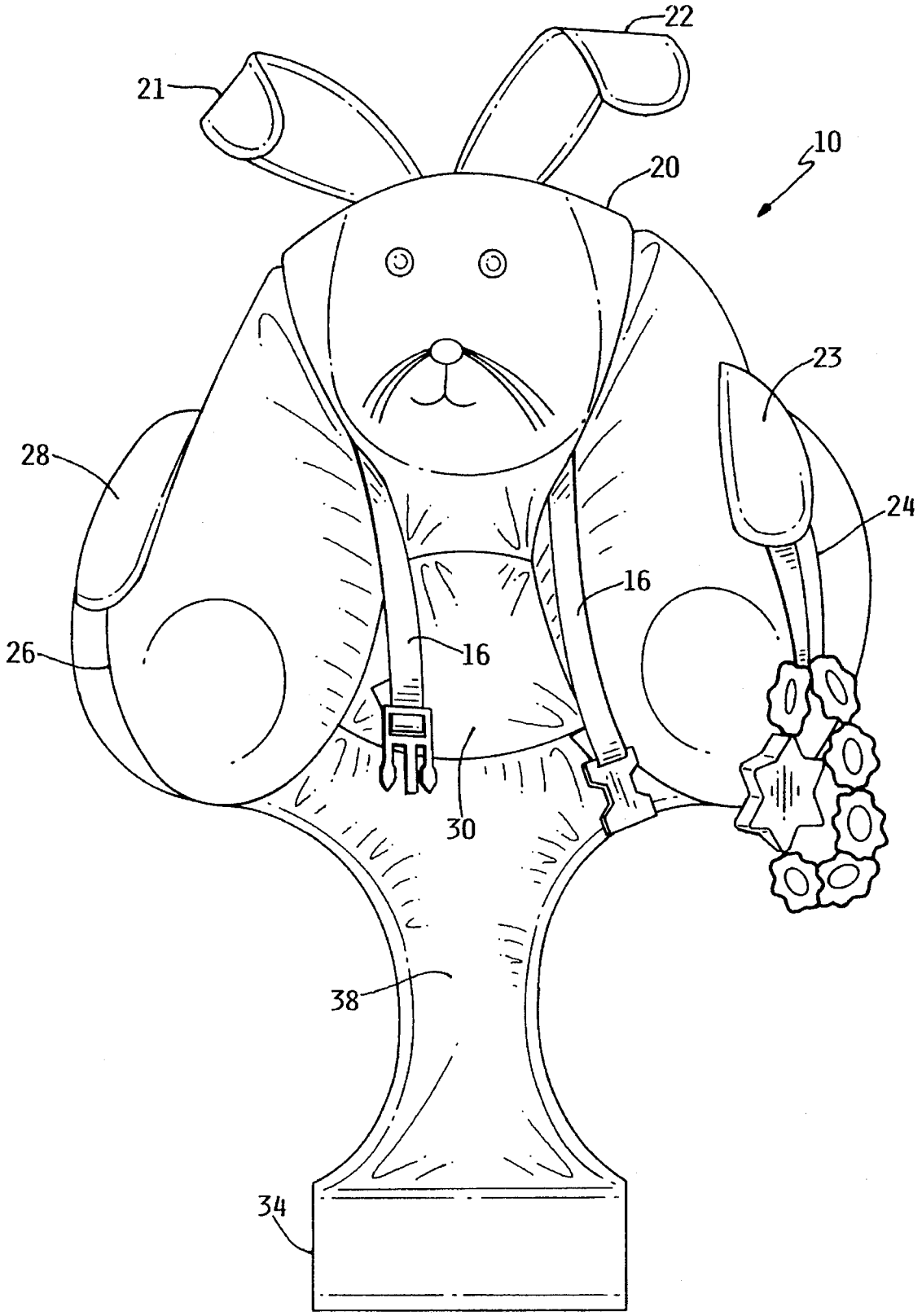
FIG. 2 shows an isometric view of the padded cushion assembly of the invention.
Figure 3:
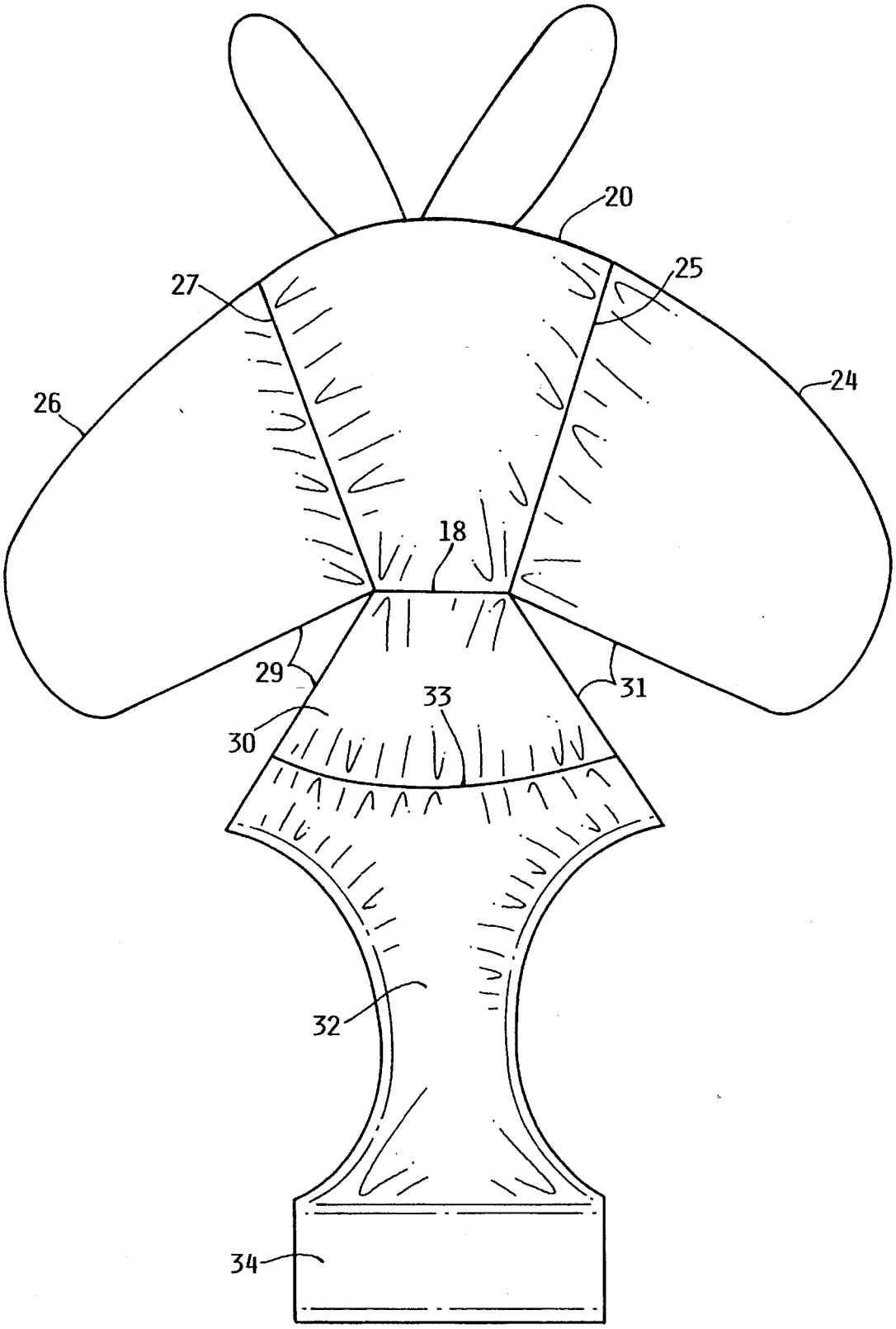
FIG. 3 shows the cushion sections in a flat layout position.

FIG. 2 shows an isometric view of the cushion assembly 10 in an embodiment which is formed into a cartoon rabbit configuration by way of example, and not by way of limitation. It is apparent that the particular cartoon image selected for the cushion assembly 10 is limited only by the imagination of the designer. Cushion assembly 10 is formed from a number of cushion sections which are best identified with reference to FIG. 2 and FIG. 3. Each of these cushion sections are preferably made from a double-layer cloth material having an interior pocket for holding and confining a suitable pad, as for example a cotton or plastic foam material having a resilient cushion feel, which is compressible and which tends to return to an original cushion form. A backrest cushion section 20 may be formed with an animal or other image applied thereto, as is illustrated by the rabbit image shown in FIG. 2. In addition, the particular rabbit image shown in FIG. 2 may also have simulated rabbit ears 21, 22 as shown, which may be designed to appear as floppy appendages affixed to an edge of cushion section 20.

A left support cushion section 24 is constructed with an inner cushion layer **24*a* and an outer cushion layer 24*b*, each of said inner and outer layers having a two-panel cloth material enclosing an interior pad. Right support cushion 26 is similarly constructed with an inner cushion layer 26*a* and an outer cushion layer 26*b*, each of said inner and outer layers having a two-panel cloth material enclosing an interior pad. Left support cushion layer 24*a* is affixed to backrest cushion section 20 along a seam 25, and right support cushion layer 26*a* is affixed to backrest cushion section 20 along a seam 27. A simulated arm or leg 23 may be affixed to left support cushion section 24, and a simulated arm or leg 28 may be affixed to right support cushion section 26, as shown in FIG. 2**. Each of these members may be made from a cloth material which is graspable by an infant seated in the support seat.

A seat cushion section 30 is similarly constructed of a two-panel cloth material enclosing an interior pad. Seat cushion section 30 is affixed to backrest cushion section 20 along a seam 18 and is affixed to left support cushion layer **24*a* along a seam 31 and is affixed to right support cushion layer 26*a* along a seam 29. In the flat layout view of FIG. 3, seams 29 and 31** are shown separated for clarity in showing the flat layout; but it should be understood that the respective cushion sections are joined together by these seams in the actual construction.

A padded crotch support 32 is affixed to seat cushion section 30 along a seam 33. Crotch support 32 has a belt sleeve 34 affixed at its distal end, and belt sleeve 34 is sized to receive the respective ends of a restraining belt 16. Restraining belt 16 has a conventional buckle arrangement and is adjustable to accommodate various sizes of infants. The buckles of restraining belt 16 may be connected inside sleeve 34; and therefore, the buckles cannot be disconnected by an infant seated in the seat.

Figure 4:
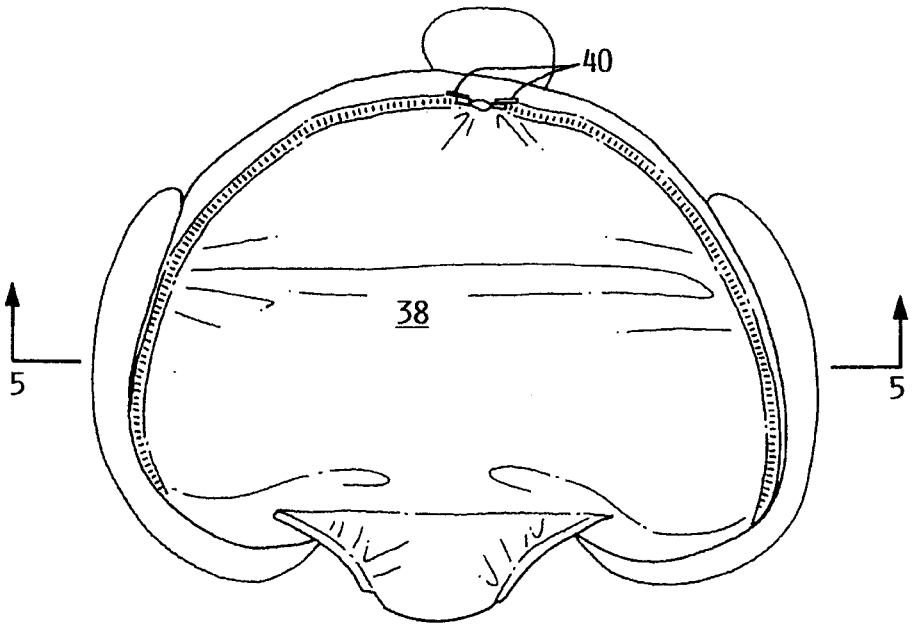
FIG. 4 shows a bottom view of the invention.

FIG. 4 shows a bottom view of the invention, wherein a release mechanism 40, such as a zipper or Velcro fastener, is arranged along the rear edge of the outside cover 38. Release mechanism 40 may be opened to permit the seat 12 and base support member 14 to be installed and removed from the inside of the cushions.

Figure 5:
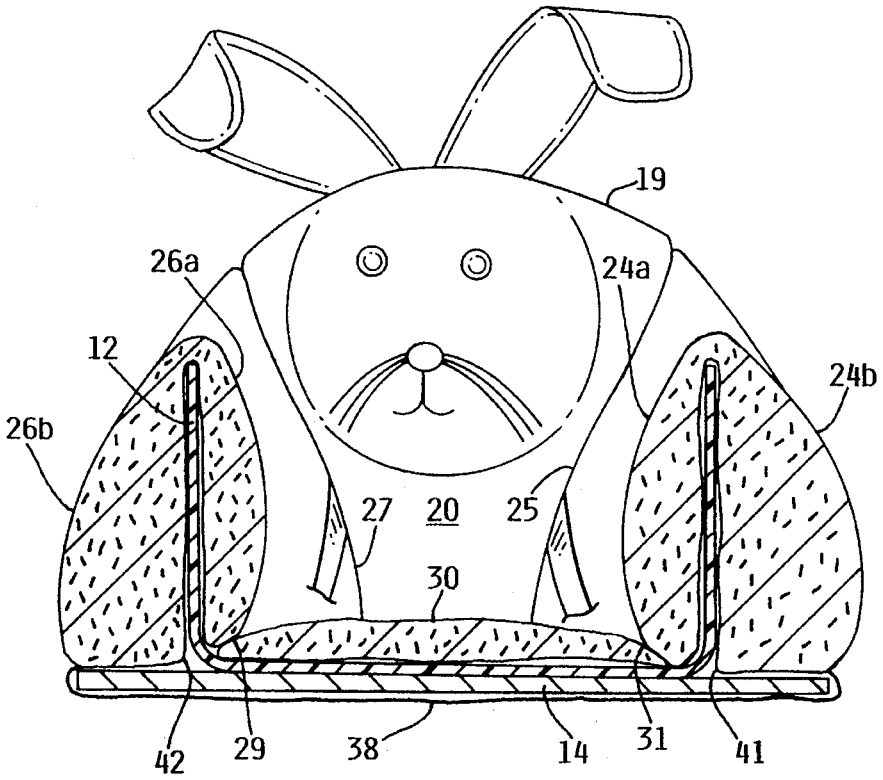
FIG. 5 shows a cross section view taken along the lines 5—5 of FIG. 4.

FIG. 5 shows a cross-section view taken along the lines 5—5 of FIG. 4. This view illustrates the interior pocket which is created to confine the molded seat and backrest 12 and base support member 14 inside the various cushion sections. This view also illustrates how left support cushion section 24 is formed into an inner layer 24*a* and an outer layer 24*b*. Likewise, right support cushion section 26 is formed into an inner layer 26*a* and an outer layer 26*b*. The respective inner layers 24*a* and 26*a* are affixed to seat cushion section 30 along seams 29 and 31, and the respective outer layers 24*b* and 26*b* are affixed to outer cover 38 along seams 41 and 42. Backrest cushion section 20 does not have a comparable inner and outer cushion layer but is defined by an inner cushion section 20 which is affixed to outer cover 38 along its upper edge seam 19. A pocket (not shown) may be added to the outside of outer cover 38 in the area behind the backrest 12.

In operation, the molded seat and backrest 12 and the base support member 14 may be inserted into the cushion assembly 10 by opening the release mechanism 40 which reveals the interior pockets sized to receive these parts. The molded seat and backrest and the base support member are positioned inside the respective pockets as shown, and the release mechanism is fastened to hold these parts inside the cushion assembly 10. The procedure is reversed to remove the molded seat and backrest 12 and the base support member 14. The infant may be seated into the cushion assembly 10 between the armrests and the crotch support 32 may be brought up between the infant's legs, and the restraining belt 16 may be fastened. The restraining belt buckles are moved inside the sleeve 34, and the apparatus is ready for use.

The foregoing description of a preferred embodiment of the invention is illustrative of a preferred construction and is not intended to be limiting of the scope of the invention; it is desired that the scope of the invention be limited solely by the claims appended hereto.

What is claimed is:

1. An infant support seat and cushion, comprising:

a) a seat and backrest member affixed to a base support member, said base support member having a flat form and extending beyond said seat and backrest member;

b) a cushion assembly having an interior opening sized to receive said seat and backrest member and said base support member, said cushion assembly further comprising a backrest cushion section overlying said backrest member, a seat cushion section overlying a portion of said base support member, and right and left support cushion sections overlying respective portions of said seat and backrest member; said backrest cushion section, said seat cushion section, and said right and left support cushion sections being affixed together along respective joining seams;

c) a crotch support strap affixed to said seat cushion and a pair of belt sections respectively affixed to said right and left support cushion sections and engageable with said crotch support strap; and d) an outer cover fitted over said base support member and portions of said seat and backrest member, said outer cover having a release mechanism whereby said seat and backrest member and said base support member may be removably inserted between said outer cover and said cushion sections.

2. The support seat and cushion of claim 1, wherein said seat and backrest member further comprises a left and a right support wall section extending forwardly from a backrest wall section, and said left and right support cushion sections respectively over said left and right support wall sections.

3. The support seat and cushion of claim 2, wherein said right and left support cushion sections each further comprise an inner cushion layer and an outer cushion layer, and said respective left and right support walls are inserted between said inner and outer cushion layers.

4. The support seat and cushion of claim 3, further comprising at least one infant toy affixed to at least one of said right and left support cushion sections.

5. The support seat and cushion of claim 4, wherein said at least one infant toy further comprises an audible sound device actuable by touch.

6. The support seat and cushion of claim 4, wherein said crotch support strap further comprises a sleeve at a distal end, said sleeve sized to receive said pair of belt sections.

* * * * *

UNITED STATES PATENT AND TRADEMARK OFFICE

CERTIFICATE OF CORRECTION

PATENT NO. : 5,551,749

DATED : September 3, 1996

INVENTOR(S) : CHILD SUPPORT CUSHION

It is certified that error appears in the above-indentified patent and that said Letters Patent is hereby corrected as shown below:

Column 1, line 34, "another object" should be -- Another object --.

In claim 1, column 4, line 12, "overlying a portion" should be -- overlying said seat and a portion --.

In claim 2, column 4, line 33, "respectively over" should be -- respectively extend over --.

Signed and Sealed this

Nineteenth Day of November, 1996

*Attest:*

Bruce Lehman

BRUCE LEHMAN

*Attesting Officer*

*Commissioner of Patents and Trademarks*